US006253046B1

(12) United States Patent
Horrall et al.

(10) Patent No.: US 6,253,046 B1
(45) Date of Patent: Jun. 26, 2001

(54) MULTI-FUNCTIONAL FUSER BACKUP ROLL RELEASE MECHANISM

(75) Inventors: Paul Douglas Horrall; Alexander Douglas Meade; Edward Alan Rush; Krikor Yosmali, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/552,273

(22) Filed: Apr. 19, 2000

(51) Int. Cl.[7] ..... G03G 15/00; G03G 15/20

(52) U.S. Cl. ..... 399/124; 219/216; 399/21; 399/45; 399/122; 399/126; 399/328; 430/124

(58) Field of Search ..... 399/122, 124, 399/125, 126, 107, 21, 45, 322, 328; 219/216, 243; 430/124

(56) References Cited

U.S. PATENT DOCUMENTS

| | | | |
|---|---|---|---|
| 3,973,844 | 8/1976 | McCarroll . | |
| 4,162,847 | 7/1979 | Brandon . | |
| 4,498,757 | 2/1985 | Lance et al. . | |
| 4,673,283 | 6/1987 | Hisajima et al. . | |
| 4,716,435 | 12/1987 | Wilson . | |
| 4,819,020 | 4/1989 | Matsushiro et al. . | |
| 4,825,242 | 4/1989 | Elter . | |
| 4,958,195 | 9/1990 | Firth, III et al. . | |
| 5,170,214 | 12/1992 | Negoro et al. . | |
| 5,191,375 | 3/1993 | Hamilton . | |
| 5,307,134 | 4/1994 | Nakajima et al. . | |
| 5,323,216 | 6/1994 | Mahoney . | |
| 5,325,166 | 6/1994 | Hamilton . | |
| 5,331,384 | 7/1994 | Otzuka . | |
| 5,384,631 | 1/1995 | Matsunami . | |
| 5,404,200 | 4/1995 | Martin et al. . | |
| 5,406,362 | 4/1995 | Mills . | |
| 5,436,430 | 7/1995 | Baruch et al. . | |
| 5,450,187 | 9/1995 | Pei et al. . | |
| 5,481,346 | 1/1996 | Ohzeki et al. . | |
| 5,517,293 | 5/1996 | Tonai et al. . | |
| 5,519,478 | 5/1996 | Malachowski . | |
| 5,581,341 | 12/1996 | Tanaka . | |
| 5,661,550 | 8/1997 | Ko . | |
| 5,669,039 | 9/1997 | Ohtzuka et al. . | |
| 5,682,577 | 10/1997 | Kiyoi . | |
| 5,689,788 | 11/1997 | Moser . | |
| 5,708,920 | 1/1998 | Ohnishi et al. . | |
| 5,724,638 | 3/1998 | Isogai et al. . | |
| 5,737,664 | 4/1998 | Fukuda et al. . | |
| 5,742,865 | 4/1998 | Yajima et al. . | |
| 5,832,330 | 11/1998 | Kiyoi . | |
| 5,832,340 | 11/1998 | Kosagi et al. . | |
| 5,835,835 * | 11/1998 | Nishikawa et al. | 399/328 |
| 5,862,435 | 1/1999 | Suzumi et al. . | |
| 5,878,301 | 3/1999 | Katakura et al. . | |
| 5,899,598 | 5/1999 | Yamauchi . | |
| 5,998,761 * | 12/1999 | Berkes et al. | 219/216 |
| 6,035,160 * | 3/2000 | Kim | 399/122 |

* cited by examiner

*Primary Examiner*—Sophia S. Chen
(74) *Attorney, Agent, or Firm*—Taylor & Aust, P.C.

(57) ABSTRACT

A multi-functional fuser backup roll release mechanism and operating process are defined. In the event of a paper jam, the primary gear train from a prime mover to driven rolls of the imaging apparatus is interrupted, and a secondary drive train is engaged. The drive train operates a drive shaft, rotating a worm gear to control a cam and lever apparatus connected to springs and bellcranks at opposite ends of the backup roll. Upon the detection of a paper jam, or prolonged inactivity of the fuser, the nip between the fuser hot roll and backup roll is opened. During normal operation, the mechanism can be used to control the nip force between the fuser roll and the backup roll, to provide the optimal nip load for the media being processed, and the print glossiness desired.

27 Claims, 8 Drawing Sheets

MULTI-FUNCTIONAL FUSER BACKUP ROLL RELEASE MECHANISM

BACKGROUND OF THE INVENTION

1. Field of the Invention

The present invention relates to an electrophotographic imaging apparatus, and more particularly to a nip biasing and backup roll release mechanism in the fuser roll assembly for such an apparatus.

2. Description of the Related Art

In the electrophotographic process commonly used in printers and the like, an electrostatic image is created on photosensitive material such as a belt or roll. Minute electroscopic particles, commonly called toner particles, are applied to the electrostatic image on the photosensitive material. The toner image is then transferred to the desired media, which may include paper, card stock, envelopes, transparencies or the like.

To permanently adhere the toner to the media, the media, with the toner image thereon, is passed through a fuser unit, in which heat and pressure are applied to the image. The heat causes constituents of the toner to flow into the pores or interstices between fibers of the media. Pressure promotes settling of the toner constituents into these voids. As the toner is cooled, it solidifies and adheres the image to the media.

A commonly used fuser is a roll fuser, consisting of two rolls nipped together, with at least one roll being internally heated. The nonheated roll, or backup roll, is urged against the hot roll, to form a fuser nip through which the media passes. Nip pressures in the fuser can be high, often being at least 13 psi.

A common problem with roll fusers is the need to relieve the nip when paper jams occur. It is essential that a user be able to remove simple jams easily, without the need for service calls. Known procedures for clearing jams in a fuser include: allowing the fuser roll to free-wheel in the process direction during jam conditions, by disengaging the fuser drive when the jammed media is pulled; implementing a user activated manual lever to separate the backup roll from the hot roll, and thereby relieve the nip pressure; implementing a backup roll release lever which is activated by opening a jam access door, to thereby relieve nip pressure; or implementing a jam clearance knob which is activated by the user to turn the fuser rolls and expel the jammed media from the fuser without relieving nip pressure.

While the mechanisms described above typically achieve the desired function for clearing media jams, in some situations, and for some machine architectures, each has draw backs and disadvantages. In a machine architecture in which the paper process direction runs perpendicular to the front of the machine, it is often desirable, and frequently necessary, to allow the user to clear jams both from the front of the machine and from the side of the machine. It is further necessary to allow the user to clear jams from both the pre-fuser and the post-fuser areas of the imaging apparatus. Typically, in the aforedescribed machine architecture, the pre-fuser area is accessible from the front of the machine, such that jammed sheets are extricated perpendicular to the process direction. In the post-fuser area, accessed from the side of the machine, the jammed sheets are removed generally parallel to the process direction.

Allowing free-wheeling of the fuser in the process direction is sufficient to clear jammed pieces of media that can be extricated in the same direction as the process direction, such as in the post-fuser area. However, clearing jams from the front of the machine, such as the pre-fuser area, where the jammed media must be removed in a direction that is perpendicular to the process direction, is more difficult. If jammed sheets are removed across the process direction, free-wheeling of the fuser rolls, which does not relieve nip pressure, is not helpful in freeing the jammed media. Pulling on a sheet still nipped between fuser rolls often results in the sheet tearing. When this occurs, it is difficult to remove the torn sheet remnants, which may be small and virtually inaccessible. In extreme cases, removal of the entire fuser may be required to gain access to the remaining torn pieces. This may require a service call by technicians, which can be expensive, and delays having the machine in service.

Incorporating jam clearance knobs may improve the above scenario for clearing jams, since the user will then have means to expel the sheet from the nip, thus reducing the likelihood of tearing. However, the knob will be accessible only from either the front or the back of the machine, unless two knobs are used, which in itself is undesirable in utilizing more space in a relatively compact and crowded housing.

A more desirable jam clearance approach for a machine architecture in which the paper process direction runs perpendicular to the front of the machine is to physically open the fuser roll nip, thereby allowing the media to be extricated from the fuser, with little or no resistance, in either the process direction or the cross process direction. In the past, typical means for opening the nip have included manual levers and levers actuated by opening jam access doors. If a manual lever is used, for the ease and convenience of the user, the manual lever linkage should be accessible from both the front and side locations of the machine. Such an arrangement itself is complicated, utilizing much interior space of the apparatus. In a door actuated lever design, reinforcement of the doors is necessary, to carry the extra load required to force the fuser nip open. Long actuating levers may be required. While either of these approaches may be functional, they are costly and inconvenient solutions.

What is needed is a fuser backup roll release mechanism which can be activated conveniently to clear media jams in the pre-fuser and post-fuser areas as well as at the fuser nip, and which allows removal of the media from the fuser in both the process direction and the cross-process direction.

An additional problem of roll fusers of the type described above is that the typical roll fuser operates at a single nip pressure. This pressure may be greater than the optimal pressure under some circumstances. For example, passing envelopes through printers utilizing roll fusers often results in the envelope becoming wrinkled. If a lower nip pressure were available in the roll fuser, wrinkling would be minimized. Similarly, it may be desirable to utilize higher nip pressures in the roll fuser for card stocks and labels than for envelopes or other standard media. Transparency sheets also may be treated, ideally, with nip pressures different from those used for other media types. Additionally, it may be useful to control fuser roll nip pressure to achieve desired print characteristics, such as glossiness.

What is needed is a roll fuser backup roll biasing mechanism capable of multiple settings, so that preferred nip pressure settings can be implemented for the media being processed.

Another problem encountered with roll fusers is that referred to as compression set of the elastomer covers on the rolls. Compression set, which is a distortion in the shape of the elastomer cover, can occur if the fuser roll and backup roll remain for an extended period of time in a fixed nip relationship under pressure. When the apparatus is used, as the rolls rotate, the nip area transfers about the periphery of the roll as it rotates. If the apparatus sits for an extended period of time without being used, such that the rolls do not rotate, the nip remains fixed in position on each roll. The pressure applied to a discrete area of the roll surface can cause roll cover distortion.

What is needed is a roll fuser backup roll biasing mechanism and control procedure which automatically relieves nip pressure if the apparatus sits for an extended period of time without operating.

SUMMARY OF THE INVENTION

The present invention provides a multi-functional fuser backup roll biasing and release mechanism, which can provide multiple nip pressure settings or open the nip completely. Under jam conditions, or after prolonged inactivity, the mechanism adjusts automatically to open the nip. During use, nip pressures can be adjusted for the type of media being processed.

The invention comprises, in one form thereof, a backup roll release mechanism including loading arms in the form of bellcranks attached to opposite ends of the fuser backing roll, and a variable loading apparatus to provide loading force to the loading arms. Loading force may come from springs, adjustment of which is made by a gear train and cam adjusted levers. Advantageously, the gear train connects with an existing gear train of the fuser unit by means of a swing link, to alternatively engage the fuser gear train or the fuser nip loading gear train.

An advantage of the present invention is the convenient relieving of nip pressure in the fuser roll nip, to remove media jams in both the process direction and the cross-process direction.

Another advantage of the present invention is providing a backup roll biasing mechanism capable of multiple settings for different media types.

Yet another advantage of the present invention is the minimization of wrinkling during processing of envelopes and the like by adjusting fuser nip pressures for the media type being processed.

A further advantage of the present invention is the minimization of compression set in the elastomeric covers of the fuser rolls, by relieving the nip pressure between the fuser roll and the fuser backing roll when the imaging apparatus is not operated for a specified period of time.

A still further advantage of the present invention is the simplification of jam clearance procedures, by automatically freeing media held in the fuser, thereby allowing simple user intervention without requiring the user to engage, disengage or operate media jam clearance apparatuses.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
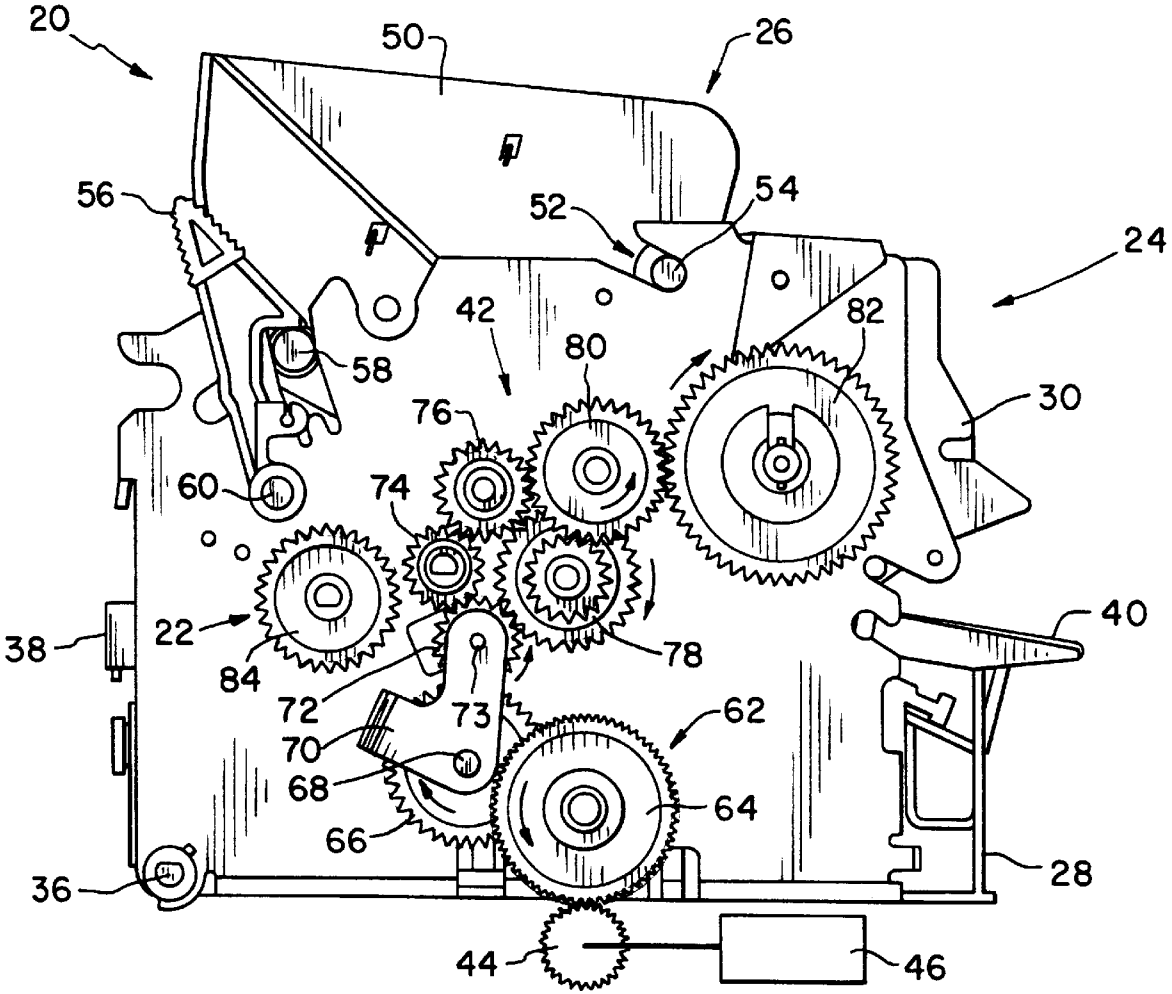
FIG. 1 is a side elevational view of a fuser unit in an imaging apparatus, in which the present invention for a multi-functional fuser backup roll release mechanism may be used advantageously.

Corresponding reference characters indicate corresponding parts throughout the several views. The exemplifications set out herein illustrates one preferred embodiment of the invention, in one form, and a modification thereof, and such exemplifications are not to be construed as limiting the scope of the invention in any manner.

DETAILED DESCRIPTION OF THE INVENTION

Referring now more specifically to the drawings, and to FIG. 1 in particular, a fuser unit 20 is shown in which a multi-functional fuser backup roll release mechanism 22 of the present invention is advantageously employed. Fuser unit 20 is, for example, a fuser from a laser printer, or the like. However, it should be understood that the present release mechanism may be used advantageously for other types of fuser units in other types of printers, and in other types of apparatuses wherein it is desirable to modify nip pressures and/or open a nip for jam clearance. Fuser 20 is merely one example of such an apparatus, and is not intended as a limitation on the claims to follow.

Fuser unit 20 includes a fuser assembly 24 and an oil web assembly 26. Fuser assembly 24 has a fuser frame 28, including a hot roll cover 30. Within fuser frame 28 are a hot roll 32 and a backup roll 34, each more readily visible in FIG. 3.

Fuser assembly 24 is adapted for installation in a laser printer, and includes a latch cam 36 for engagement with a latch (not shown) in the printer. A handle 38 is provided on the backside of fuser frame 28, for grasping when fuser assembly 24 is to be removed from the printer it is installed in.

Figure 2:
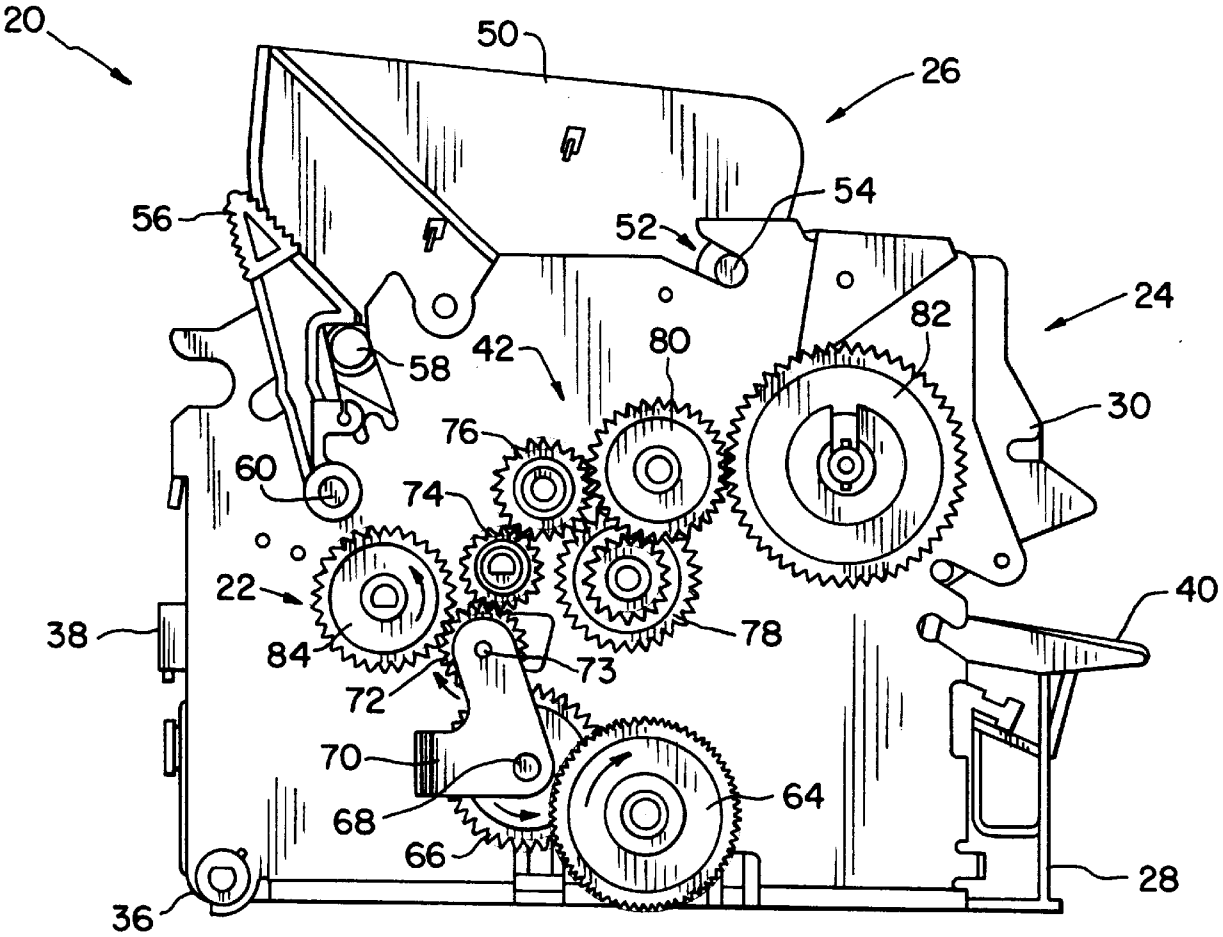
FIG. 2 is a side elevational view similar to that of FIG. 1, but showing various elements in an operating procedure different from that shown in FIG. 1.

Paper or other printed media enters fuser assembly 24 at ramp 40 and passes between hot roll 32 and backup roll 34, wherein heat and pressure are applied for thermally setting fuser particles on the media. A gear train 42 is shown in FIGS. 1 and 2, outside of fuser frame 28. Gear train 42 is used for driving hot roll 32 and various other rotary elements, not shown, in fuser assembly 24, and receives rotational power from a prime mover 44 operated by a controller 46.

Oil web assembly 26 is secured to fuser assembly 24, and includes an oil web housing 50. A slot 52 in fuser frame 28 receives a locator pin 54 extending outwardly from oil web housing 50. Oil web assembly 26 is further secured to fuser assembly 24 by a latch 56 on fuser frame 28 engaging a latch pin 58 on oil web housing 50. Latch 56 is pivotally mounted to fuser frame 28 about a pin 60. It should be understood that similar securing devices are provided on the side opposite the side shown in FIG. 1. It should be further understood that oil web assembly 26 includes a web carrying a release agent for application on hot roll 32 of fuser assembly 24. A supply spool of unused material and a take-up spool for used material are disposed in oil web assembly 26. Additional guide rolls and devices are provided for bringing the web material against hot roll 32, for the direct transfer of release agent from the web to hot roll 32. Those skilled in the art will understand the need for release agent, such as silicone oil, to be applied to hot roll 32 to prevent toner transfer from the media to hot roll 32 and to prevent media from sticking to hot roll 32 in most color printers. Those skilled in the art will also understand that the present invention can be used advantageously in many printers not requiring an oil web assembly 26, such as many monochrome printers. Operation of oil web assembly 26 is not relevant to an understanding of the present invention, and will not be explained in further detail herein.

It should be further understood that the external views of FIG. 1 and FIG. 2 have been simplified, with various covers and guards not being shown. Further, numerous other elements such as electrical connections, lamps and lamp brackets and the like have not been shown, in that the operation thereof is readily understood by those skilled in the art and, further, an understanding thereof is not required for an understanding of the present invention.

Gear train 42 is provided for driving various rolls in fuser unit 20. The components of gear train 42 shown in FIG. 1 and FIG. 2 are primarily those for driving the various rolls in fuser assembly 24 of fuser unit 20. Individuals skilled in the art will readily understand that, on the side of fuser unit 20 opposite the side shown in FIG. 1 and FIG. 2, an additional gear train is provided, for driving additional components of fuser unit 20, including the various rolls and spools of oil web assembly 26.

Gear train 42 is a plurality of intermeshed gears, and includes a compound gear 62 driven by prime mover 44, such as a motor. Operation of primer mover 44 is controlled by controller 46, which sends start, stop and rotational direction signals to prime mover 44. In known manner, controller 46 receives data input signals on media types being processed, time cycles of inactivity, the progress of media being processed by fuser 20, and the like. From such data, control signals are issued to prime mover 44.

Compound gear 62, has a helical gear portion 64 driven by a helical gear powered by prime mover 44. A spur gear portion, not shown, of compound gear 62 engages a second fuser gear 66 rotatable about a shaft 68. In accordance with the present invention, also mounted on shaft 68 is a swing arm 70 carrying a reversing gear 72 on a stud 73. Operation of swing arm 70 and reversing gear 72, per the present invention, will be described more fully hereinafter. Additional gears shown of gear train 42 include an exit roll gear 74, an idler gear 76, and fuser roll gears 78 and 80. Fuser hot roll 32 is driven by a hot roll gear 82. A backup roll release gear 84 is provided, and may be optionally engaged with reversing gear 72, also in a manner to be described hereinafter.

Figure 3:
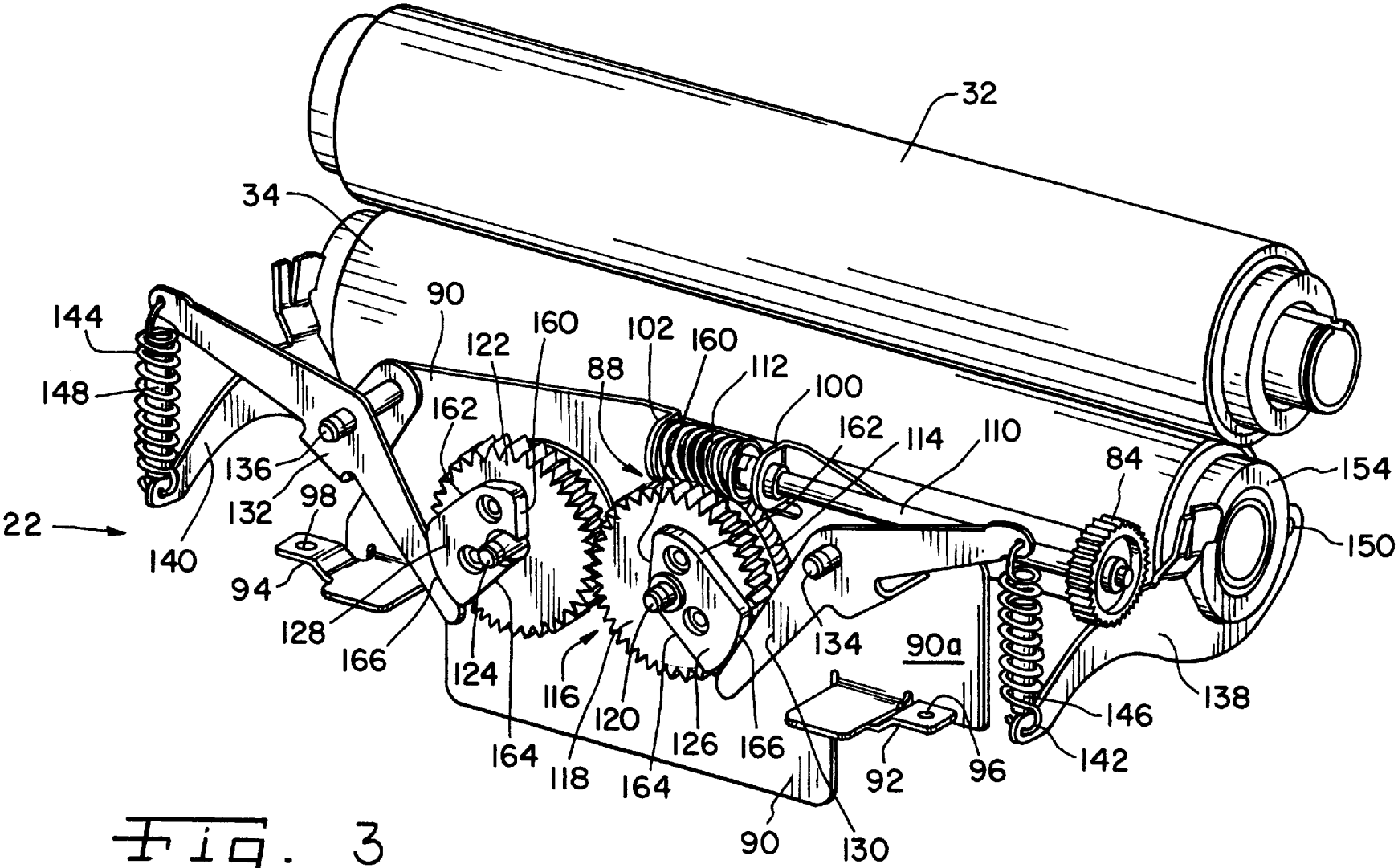
FIG. 3 is a fragmentary view of the fuser unit, showing the present multi-functional fuser backup roll release mechanism.

Backup roll release mechanism 22 will be explained in greater detail with reference to FIG. 3. A drive train 88 is provided, supported by a frame 90 which includes tabs 92 and 94, and holes 96 and 98 for locating and securing the assembled backup roll release mechanism 22 in fuser unit 20. Tabs 100 and 102 are provided on frame 90 for carrying a shaft 110 of drive train 88, suitably journaled therein. Backup roll release gear 84 is connected to shaft 110, at one end thereof, for direct rotation therewith. A worm gear 112 is attached to shaft 110, intermediate tabs 100 and 102. Worm gear 112 is operatively engaged with a helical gear 114, which is a part of a compound gear 116, compound gear 116 also having a spur gear 118. Preferably, helical gear 114 and spur gear 118 are portions of a single component compound gear 116, mounted for rotation on a shaft 120. Spur gear 118 is operatively engaged with and drives a second spur gear 122 mounted for rotation on a shaft 124. Cams 126 and 128 are connected to spur gears 118 and 122, respectively. Cams 126 and 128 engage levers 130 and 132, each pivotal about a shaft 134 and 136, respectively. Shafts 120, 124, 134 and 136 are carried by a rear wall 90*a* of frame 90, which also may include a front wall portion 90*b* shown in FIG. 8 carrying the ends of shafts 120, 124, 134 and 136 visible in the drawings.

Compound gear 116, spur gear 122 and levers 130 and 132 may be carried on shafts 120, 124, 134 and 136, respectively, for rotation thereon, or may be affixed to shafts 120, 124, 134 and 136 suitably carried for rotation in walls 90*a* and 90*b* of frame 90. Cams 126 and 128 may be attached to, or an integral part of spur gear 118 and spur gear 122. Alternatively, if gears 118 and 122 are affixed to shafts 120 and 124, rotatably carried in frame 90, cams 126 and 128 may be affixed to shafts 120 and 124, respectively, and independent of gears 118 and 122.

Bellcranks 138 and 140 are connected to opposite ends of backup roll 34, and are joined to levers 130 and 132, respectively, by springs 142 and 144. Thus, spring 142 is connected at one end to a first end of lever 130 and at its other end to bellcrank 138. Spring 144 is connected at one end to a first end of lever 132 and at its other end to bellcrank 140. A second end of lever 130 and a second end of lever 132 are engaged by cams 126 and 128, respectively. Spring limiters 146 and 148 are disposed inside of springs 142 and 144, respectively. Limiters 146 and 148 restrict over compression of springs 142 and 144 by limiting the downward movement of levers 130 and 132 with respect to bellcranks 138 and 140, respectively. While limiters 146 and 148 are shown as rods or the like disposed within the coils of springs 142 and 144, it should be understood that limiters 146 and 148 can also take the form of sleeves surrounding springs 142 and 144, or can be extensions of levers 130 and 132, or of bellcranks 138 and 140.

Figure 5:
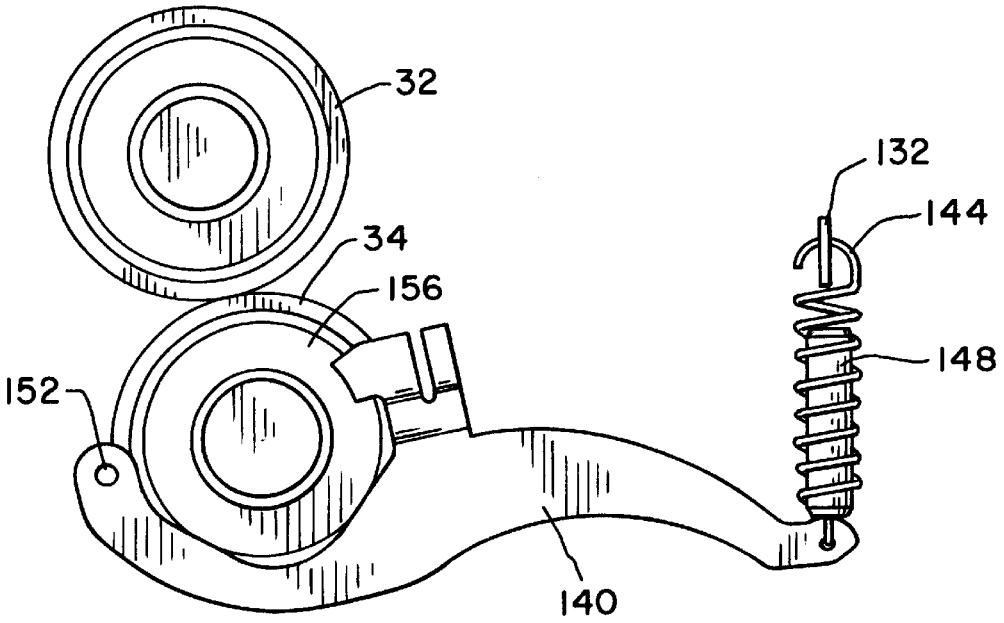
FIG. 5 is a side elevational view of the release mechanism shown in FIG. 4.

Bellcrank 138 is pivotal about an axis 150, and bellcrank 140 is pivotal about an axis 152 (FIG. 5). Pivotal axis 150 and pivotal axis 152 may be defined by separate pins or by a single rod extending between bellcranks 138 and 140 and attached to fuser frame 28. Inwardly of axis 150, bellcrank 138 is adapted to receive a first bearing 154 rotatably holding a first end of backup roll 34. Inwardly of axis 152, bellcrank 140 is adapted to receive a second bearing 156 rotatably holding a second end of backup roll 34. Bellcranks 138 and 140 operate as positioners of backup roll 34, each pivoting about its respective axis to position backup roll 34 nearer to, or farther from hot roll 32. Springs 142 and 144 operate as variable force applicators in applying force on bellcranks 138 and 140. More or less force is applied depending on the length to which springs 142 and 144 are stretched. Levers 130 and 132, operated by drive train 88, adjust the lengths to which springs 142 and 144 are stretched.

As can be seen from the series of drawings 4 through 9, rotation of shaft 10 and worm gear 112 thereon rotates helical gear 114 and spur gears 118 and 122 equally. As spur gears 118 and 122 rotates the positions of cams 126 and 128 on levers 130 and 132 change, causing the ends of levers 130 and 132 riding against cams 126 and 128 to move upwardly or downwardly as determined by cams 126 and 128. Cams 126 and 128 have a plurality of lobes and/or lands 160, 162, 164 and 166, each a pre-selected different distance from shafts 120 and 124. With respect to each other, cams 126 and 128 are mounted such that as the cams are rotated, each is moved to bring the corresponding similar surface in contact with levers 130 and 132, respectively. Depending on the positions of cams 126 and 128, different nip pressures can be achieved between hot roll 32 and backup roll 34.

Figure 4:
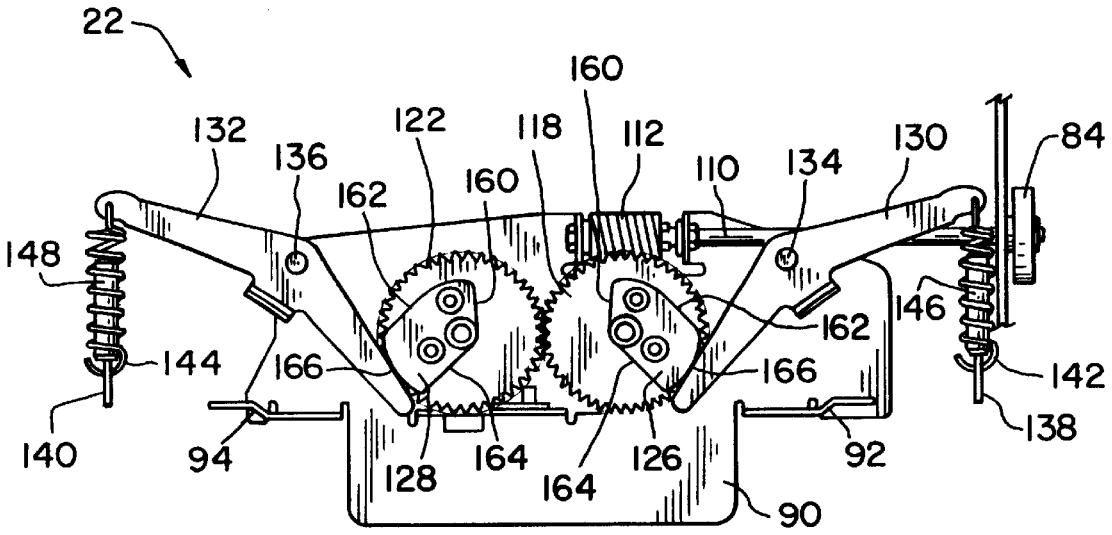
FIG. 4 is a further fragmentary elevational view of the multi-functional fuser backup roll release mechanism in one state of operation.

In the state of operation shown in FIG. 4, the largest lobed portions of cams 126 and 128 are engaging levers 130 and 132, pushing the inner ends of levers 130 and 132 downwardly at the engagement with cams 126 and 128. In turn, the opposite or outer ends of levers 130 and 132 move upwardly, pulling the ends of springs 142 and 144 upwardly, exerting additional force on bellcranks 138 and 140, thereby increasing the nip load between hot roll 32 and backup roll 34.

Figure 6:
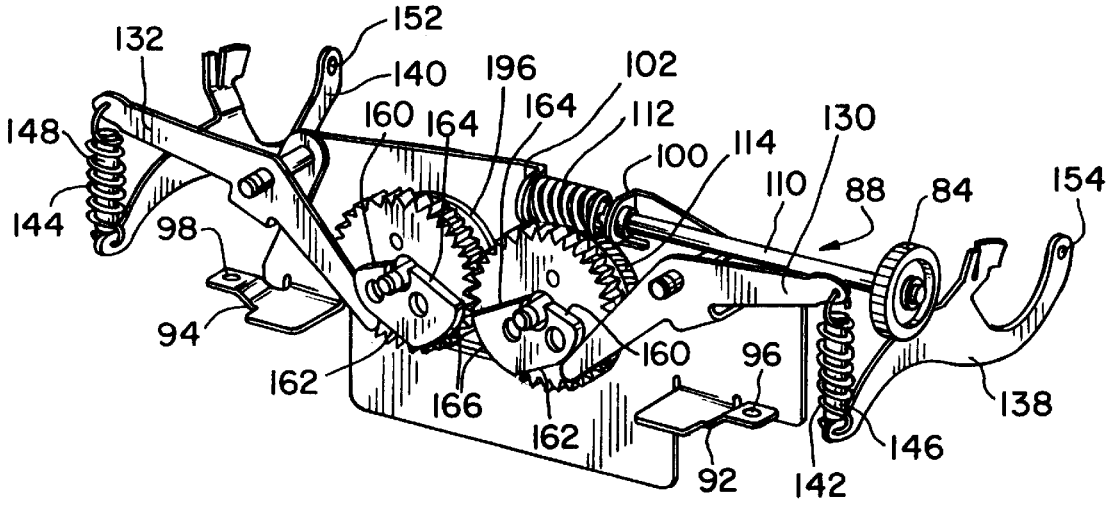
FIG. 6 is a further fragmentary perspective view of the multi-functional fuser backup roll release mechanism of the present invention shown in a further state of operation.

In the state of operation illustrated in FIG. 6, an intermediate dimension lobe of cams 126 and 128 is engaged with levers 130 and 132, respectively. The inner ends of levers 130 and 132 are positioned higher, and the outer ends thereof are positioned lower than for the state of operation shown in FIG. 4. Less spring force is applied by springs 142 and 144 to bellcranks 138 and 140 than in the state of operation shown in FIG. 4. The result is a lower nip load between hot roll 32 and backup roll 34 then for the condition illustrated in FIG. 4.

Figure 8:
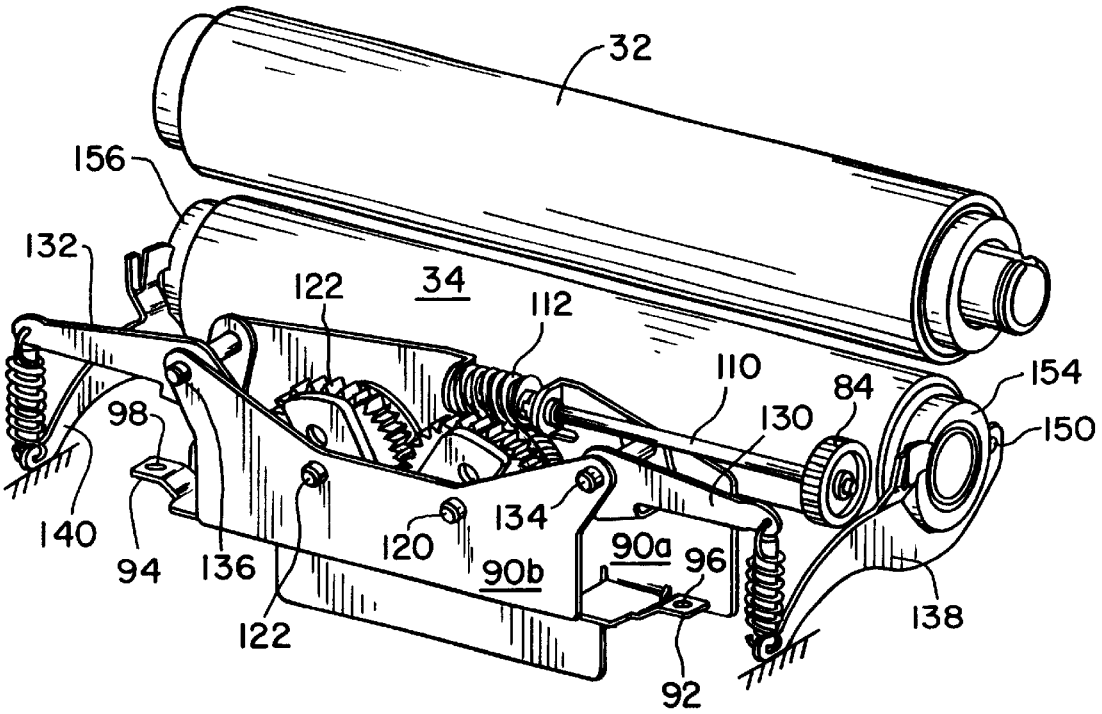
FIG. 8 is a perspective view of the multi-functional fuser backup roll release mechanism in a jam clearing mode of operation.
Figure 9:
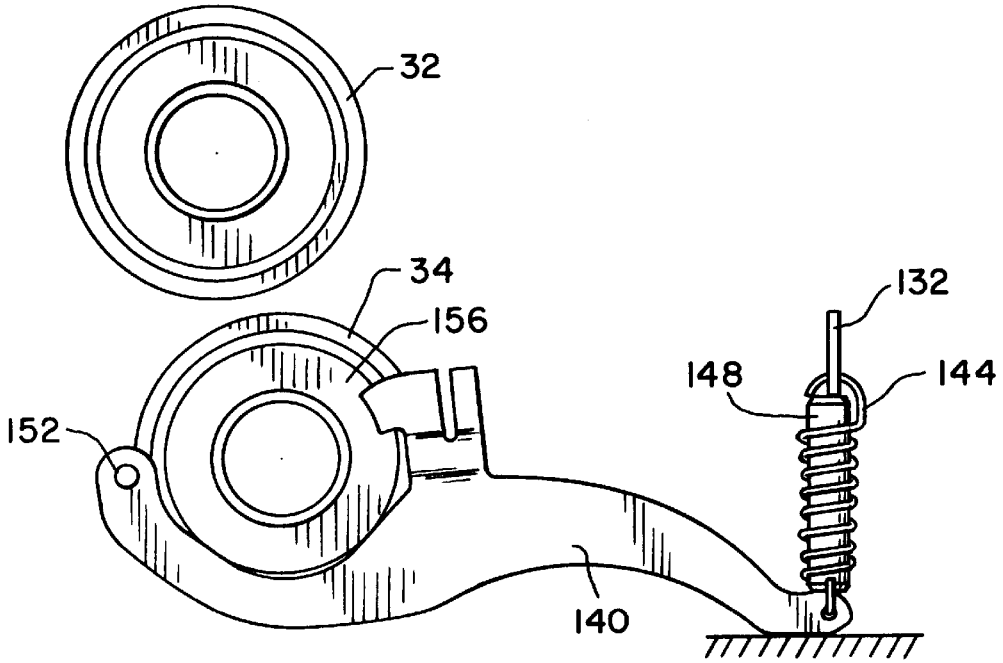
FIG. 9 is side elevational view of the mechanism shown in FIG. 8.

In FIG. 8, further rotation of spur gears 118 and 122 has caused the lobes of cams 126 and 128 having the lest radial dimension to engage levers 130 and 132, respectively. The inner ends of levers 130 and 132 are higher, and the outer ends thereof are lower than for either of the previously described states of operation. Springs 142 and 144 are moved downwardly, limited against over compression by limiters 146 and 148. In this operating condition, as seen in FIG. 9, backup roll 34 is moved away from hot roll 32, causing a gap between hot roll 32 and backup roll 34.

Figure 10:
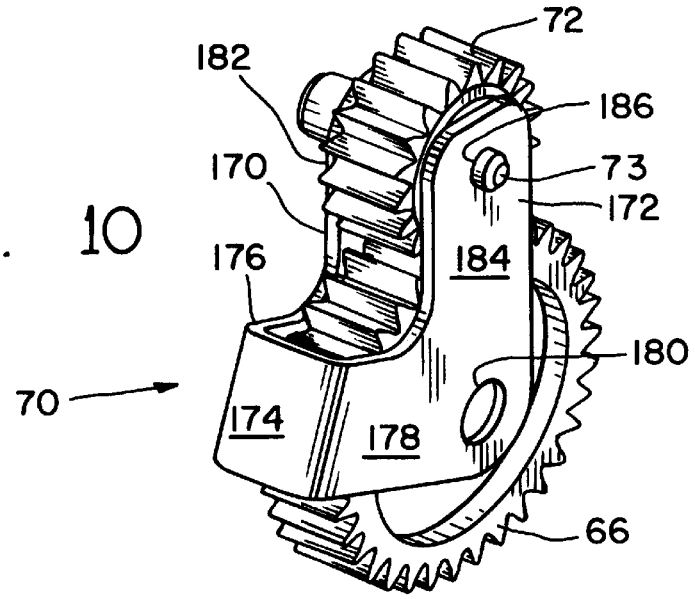
FIG. 10 is an enlarged perspective view of the swing arm assembly in the multi-functional fuser backup roll release mechanism.

Referring now to FIG. 10, the assembly for swing arm 70 is shown. Swing arm 70 is a channel-like structure having an inner wall 170, an outer wall 172 and an edge wall 174 interconnecting lower portions 176 and 178 of inner wall 170 and outer wall 172, respectively. An opening 180 is provided in lower portion 178, and a similar opening, not shown is provided in lower portion 176 for receiving shaft 68 on which fuser gear 66 is mounted. Upper segments 182 and 184 of inner wall 170 and outer wall 172, respectively are unsupported by edge wall 174. An opening 186 is provided in upper segment 184, and a similar opening, not shown, is provided in upper segment 182 for receiving stud 73 on which reversing gear 72 is mounted. While fuser gear 66 can rotate relatively freely between lower portions 176 and 178, upper segments 182 and 184 are spaced from each other a distance slightly less than the width of reversing gear 72, so that, when assembled, there is a drag force between upper segments 182 and 184 and reversing gear 72. To provide for the free rotation of fuser gear 66 and the pinch engagement of reversing gear 72, fuser gear 66 may be constructed slightly narrower than reversing gear 72.

Figure 11:
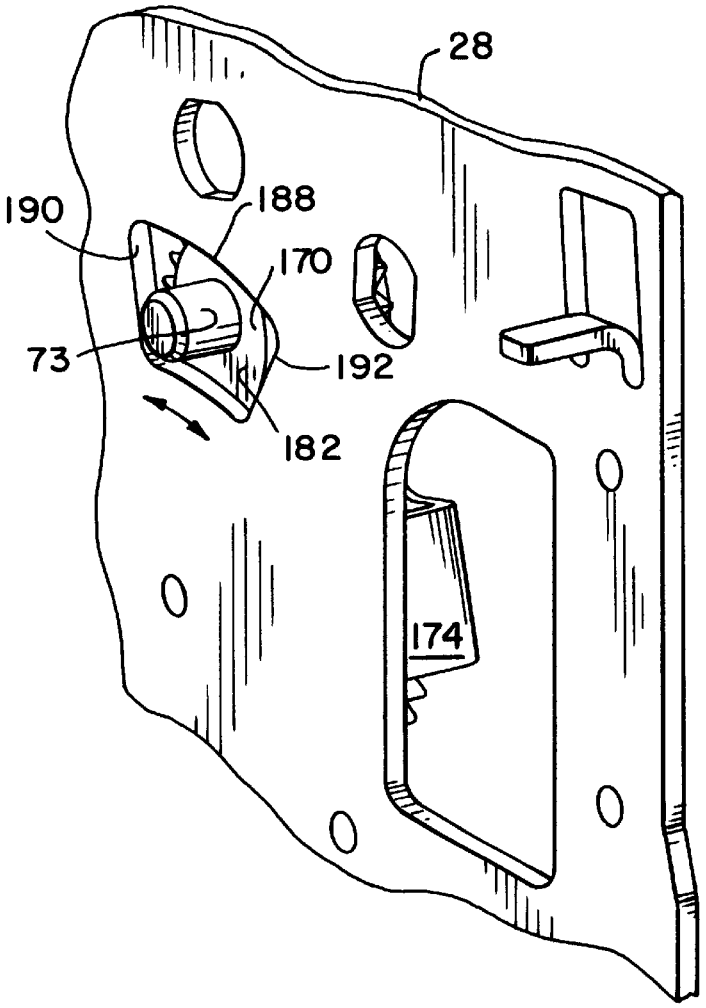
FIG. 11 is a perspective view from inside of the fuser frame.

As can be seen in FIG. 11, stud 73 extends inwardly of inner wall 170, and is positioned in a slot 188 of fuser frame 28. Slot 188 has end edges 190 and 192 which serve as stops to further movement of stud 73, and thus swing arm 70, thereby controlling the center distance between reversing gear 72 and either fuser roll gear 78 or backup roll release gear 84. It should be understood that other stops can be used to limit movement of swing arm 70, including exposed circular ribs on each of the mating gears 72, 78 and 84, contacting each other when the gears run together, or tabs in fuser frame 28 to limit movement of swing arm 70.

Figure 12:
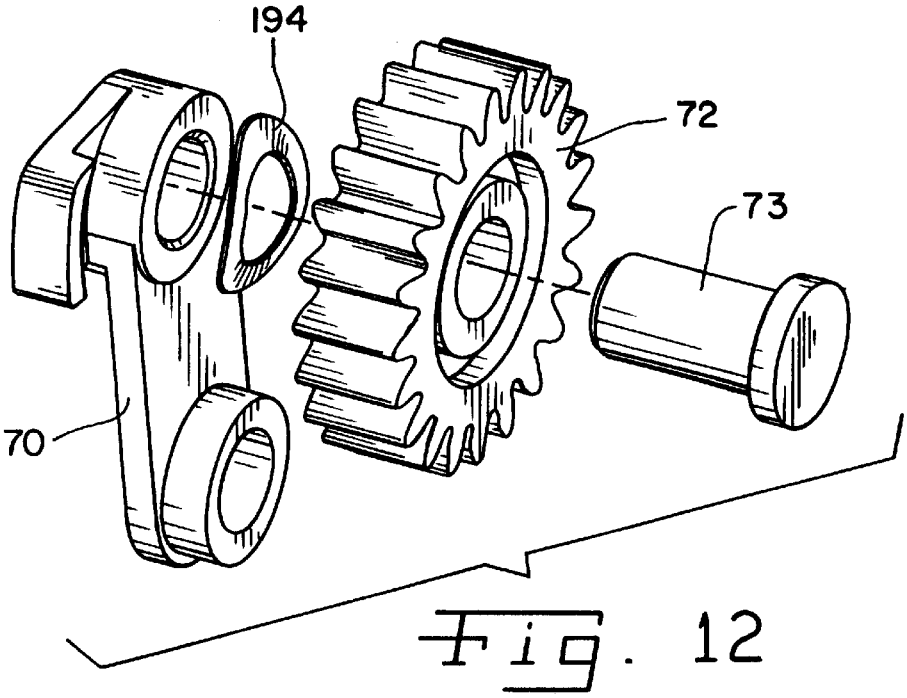
FIG. 12 is an exploded view of an alternative swing arm assembly in the multi-functional fuse backup roll release mechanism.

Referring now to FIG. 12, an alternative assembly for swing arm 70 is shown. Stud 73 extends through reversing gear 72 and swing arm 70. A thrust washer 194 is disposed on stud 73, between reversing gear 72 and swing arm 70. When assembled, thrust washer 194 is compressed between reversing gear 72 and swing arm 70, exerting spring force against each, and creating a drag force between swing arm 70 and reversing gear 72.

In either of the embodiments shown in FIGS. 10 and 12, drag resistance exists between reversing gear 72 and swing arm 70, relative to the rotation of reversing gear 72. From the position shown in FIG. 1, wherein fuser gear 66 is depicted as rotating clockwise, if fuser gear 66 is reversed, and rotated counter-clockwise, the drag resistance between reversing gear 72 and swing arm 70 causes swing arm 70 to rotate counter-clockwise about shaft 68 until further movement is prevented by stud 73 moving in slot 188 encountering an end edge of slot 188, at which location reversing gear 72 engages backup roll release gear 84. Resistance to further movement then encountered allows gear 66 to rotate relative to swing arm 70, thus driving backup roll release gear 84 as shown in FIG. 2. If the drive direction of fuser gear 66 is again reversed from that shown in FIG. 2, to again be clockwise as shown in FIG. 1, swing arm 70 will rotate upwardly to its engagement position shown in FIG. 1.

In the use and operation of a multi-functional fuser backup roll release mechanism in accordance with the present invention, under standard operating conditions, gear train 42 will be arranged as shown in FIG. 1, to drive the various components of fuser assembly 24, including hot roll 32 through the hot roll gear 82. Upon data signals indicative of a jam condition, controller 46 determines the existence of a jam condition and reverses the directional rotation of prime mover 44. As the direction of rotation of compound gear 62 is reversed, from counterclockwise as shown in FIG. 1 to clockwise as shown in FIG. 2, the frictional engagement between reversing gear 72 and swing arm 70 causes swing arm 70 to move toward backup roll release gear 84. Upon engagement of reversing gear 72 with backup roll release gear 84, reversing gear 72 begins driving backup roll release gear 84. Shaft 110 and worm gear 112 are rotated, driving helical gear 114 and spur gears 118 and 122 until cams 126 and 128 are moved to the position shown in FIGS. 8 and 9. Backup roll 34 is moved away from hot roll 32, creating a gap between backup roll 34 and hot roll 32, allowing for removal of jammed paper in either the process direction or across the process direction.

Figure 7:
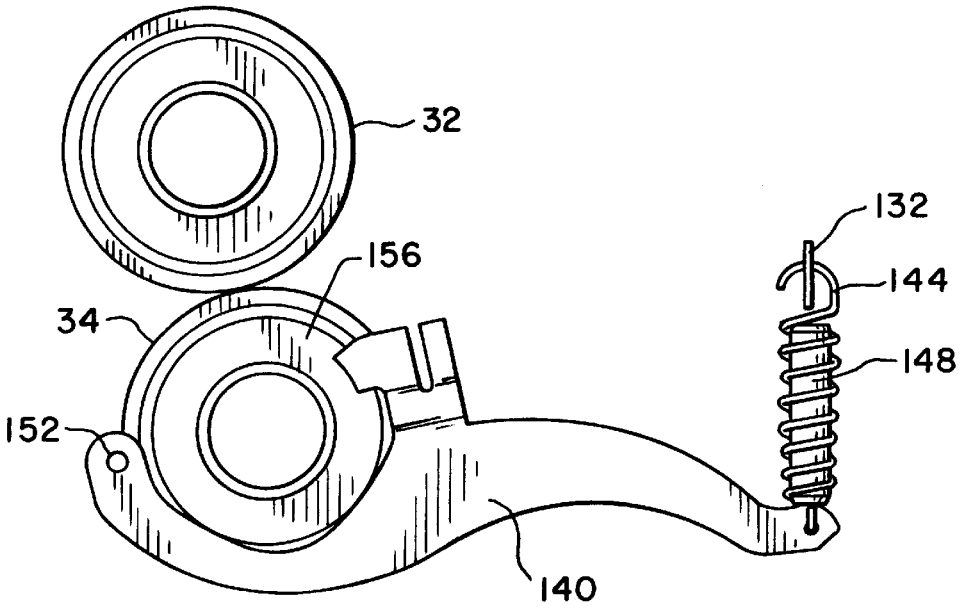
FIG. 7 is a side elevational view of the release mechanism shown in FIG. 6.

Encoder wheels and sensors of known construction, and other detection devices may be used with controller 46 to determine a precise location of spur gears 118 and 122, and thereby cams 126 and 128. From this determination, an accurate load can be determined for the nip formed between hot roll 32 and backup roll 34. In some fusing operations, it may be desirable to utilize a high nip pressure, as shown in the arrangement of FIGS. 4 and 5. In other situations, a lower nip load may be desirable, such as shown in FIGS. 6 and 7. Thus, the nip load in fuser unit 20 can be controlled as necessary for the media being printed. A properly designed worm gear set is self-locking, so that, once positioned, it will not creep or move until powered by the gear train. This ensures stable positioning of cams 126 and 128, and consistent nip pressure in the fuser nip.

Envelope wrinkling, which may occur from too high nip pressure in the fuser, can be minimized with the present invention. Print job instructions typically include the designation of a media source tray, or the nature of the media being printed on. Upon designation of an envelope as the media, a drive control, operating in conjunction with an appropriate sensor as to present cam positioning, such as an encoder wheel 196, can operate backup roll release mechanism 22 to place cams 126 and 128 in a selected position for optimal nip load. The same can be done for other nonstandard media, such as transparencies, card stock, etc.

In a similar manner, print job instructions may include a designation of certain print qualities. Control of the print glossiness can be impacted by the nip pressure in the fuser nip. The present invention provides a suitable means and apparatus to control fuser nip pressure for the purpose of affecting print glossiness.

Compression set of roll covers on hot roll 32 or backup roll 34 can be minimized with the present invention. Upon prolonged inactivity of the printer, or during shut down of the printer, the controller can activate the drive to place backup roll 34 in the position shown in FIG. 8, thereby relieving all nip pressure.

When controller 46 has determined that the desirable nip pressure has been attained for operating conditions, directional rotation of prime mover 44 is established to operate gear train 42. Under jam conditions, or upon shutdown or entry into a sleep mode due to prolonged inactivity, once controller 46 determines that hot roll 32 and backup roll 34 have separated, prime mover 44 is stopped, and neither gear train 42, nor drive train 88 is operated further, until the jam has been cleared, or machine operation requested.

By changing the shape of cams 126 and 128, the nip load settings that can be achieved can be changed. More or fewer nip load settings can be available by providing cams with more or fewer lobes.

Figure 13:
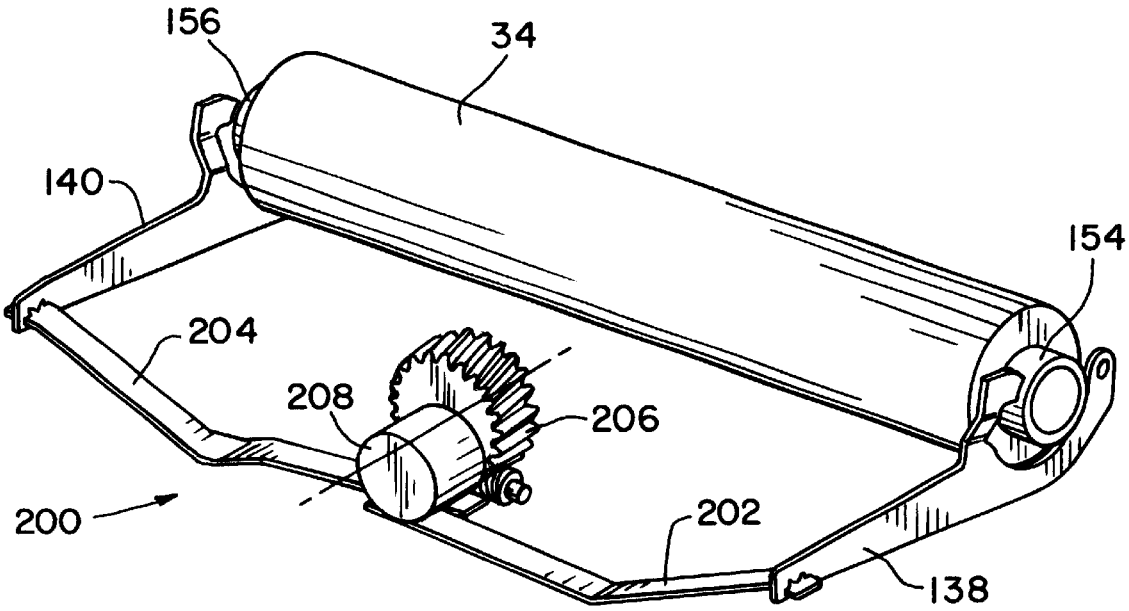
FIG. 13 is a perspective view of a modified embodiment of the present invention.

In a modified embodiment 200 shown in FIG. 13, flat springs 202 and 204 are connected to bellcranks 138 and 140, respectively. A helical gear 206 is driven by worm gear 112. A cam 208 is mounted on helical gear 206, and engages the flat springs 202 and 204. Cam 208 may take the form of a lobed body, or, as shown, an eccentrically mounted body having an outer surface of a cylinder. Spring force applied to bellcranks 138 and 140 is controlled by the position of cam 208. Through proper adjustment of cam 208 a variety of nip loads can be provided in the fuser assembly. Alternatively, a plurality of cams 208 may be used.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A backup roll release mechanism for an imaging apparatus fuser having a fuser roll and a backup roll, said release mechanism comprising:

first and second roll journals for rotatably holding said backup roll therebetween;

a first roll positioner connected to said first roll journal;

a second roll positioner connected to said second roll journal;

a first variable force applicator connected to said first roll positioner;

a second variable force applicator connected to said second roll positioner;

each said first and second variable force applicators having a plurality of force application configurations cooperatively adapted and arranged for establishing positions for said backup roll relative to said fuser roll, said positions including an open position in which said backup roll is spaced from said fuser roll and a plurality of nipped positions of different nip loads; and an adjuster connected to said first variable force applicator and to said second variable force applicator, said adjuster being adapted and arranged for placing said first variable force applicator and said second variable force applicator in selected force application configurations.

2. The backup roll release mechanism of claim 1, wherein said first roll positioner is a first bellcrank, and said second roll positioner is a second bellcrank.

3. The backup roll release mechanism of claim 2, wherein said first variable force applicator is a first spring, and said second variable force applicator is a second spring.

4. The backup roll release mechanism of claim 3, wherein said first spring and said second spring each are a flat spring.

5. The backup roll release mechanism of claim 3, wherein said first spring and said second spring each are a coil spring.

6. The backup roll release mechanism of claim 5, wherein said adjuster includes a first lever connected to said first spring and a second lever connected to said second spring.

7. The backup roll release mechanism of claim 6, wherein:

said adjuster includes a first rotatable cam and a second rotatable cam;

said first lever has a first lever first end connected to said first spring and a first lever second end associated with said first cam;

a first pivotal connection is provided for said first lever between said first lever first end and said first lever second end;

said second lever has a second lever first end connected to said second spring and a second lever second end associated with said second cam; and a second pivotal connection is provided for said second lever between said second lever first end and said second lever second end.

8. The backup roll release mechanism of claim 7, further comprising a drive train connected to said first cam and said second cam, for rotating said first cam and said second cam.

9. The backup roll release mechanism of claim 8, further comprising a first gear rotating said first cam, and a second gear rotating said second cam.

10. The backup roll release mechanism of claim 9, wherein said drive train includes a drive shaft, a worm gear on said drive shaft, and a helical gear driven by said worm gear and connected to said first gear and said second gear.

11. The backup roll release mechanism defined in claim 10, wherein said drive train includes a source of rotational power, an input gear carried on said drive shaft, and a swing link optionally engaging said input gear with said source of rotational power.

12. An imaging apparatus fuser, comprising:

a fuser gear train;

a fuser roll mounted for rotation and operatively connected to said gear train;

a backup roll mounted for rotation and disposed relative to said fuser roll for a nipped relationship with said fuser roll;

a loading apparatus having multiple nip loading positions including an open position in which said fuser roll and said backup roll are in spaced realtion, and a plurality of force applying positions providing nip loading force to said backup roll; and an adjustment apparatus configured to move said loading apparatus between said multiple nip loading positions.

13. The imaging apparatus fuser of claim 12, wherein said loading apparatus includes a spring exerting loading force on said backup roll.

14. The imaging apparatus fuser of claim 12, wherein said loading apparatus includes first and second coil springs.

15. The imaging apparatus fuser of claim 12, wherein said loading apparatus includes first and second flat springs.

16. An imaging apparatus fuser, comprising:

a fuser gear train including a driven gear; and a reversing drive;

a fuser roll mounted for rotation and operatively connected to said gear train;

a backup roll mounted for rotation and disposed relative to said fuser roll for a nipped relationship with said fuser roll;

a loading apparatus having multiple nip loading positions providing nip loading force to said backup roll; and an adjustment apparatus including a drive train configured to move said loading apparatus between said multiple nip loading positions; and said reversing drive being adapted to alternatively connect said driven gear to said fuser gear train and said drive train.

17. The imaging apparatus fuser of claim 16, further comprising a first cam driven by said drive train, a first lever operated by said first cam and connected to said loading apparatus; a second cam driven by said drive train, and; a second lever operated by said second cam and connected to said loading apparatus.

18. The imaging apparatus fuser of claim 17, wherein said loading apparatus includes a first coil spring connected to said first lever, and a second coil spring connected to said second lever.

19. The imaging apparatus fuser of claim 18, further comprising a first bellcrank and a second bellcrank connected to opposite ends of said backup roll, said first bellcrank being connected to said first coil spring and said second bellcrank being connected to said second coil spring.

20. The imaging apparatus fuser of claim 19, wherein said drive train includes a worm gear operatively connected to position said cams.

21. An imaging apparatus fuser backup roll release process, comprising the steps of:

providing an imaging apparatus fuser having a fuser roll and a backup roll in a nipped relationship, a fuser gear train, a swing arm having a reversing gear, and a backup roll release mechanism having a drive train;

determining the existence of one of the conditions of a paper jam and prolonged inactivity of the imaging apparatus fuser;

interrupting operation of the gear train;

engaging the drive train of the fuser backup roll release mechanism; and operating the drive train to separate the fuser backup roll and the fuser roll;

said interrupting step and said engaging step including operating the swing arm to reposition the reversing gear.

22. The process defined in claim 21, further comprising the step of reducing spring force applied to the backup roll.

23. A process for controlling a nip load in an imaging apparatus fuser, comprising the steps of:

providing a fuser roll, a backup roll, a fuser gear train, a prime mover operating said fuser gear train, and a nip load adjusting mechanism including a drive train operating said nip load adjusting mechanism;

providing a controller for said prime mover and data received by said controller regarding at least one of data relevant to a media type to be processed by said fuser and data relevant to desired print qualities; and operating said prime mover and disengaging one of said fuser gear train and said drive train, and engaging the other of said fuser gear train and said drive train.

24. The process of claim 23, further comprising the steps of determining the existence of a period of prolonged fuser inactivity, and operating said drive train to separate said fuser roll and said backup roll.

25. The process of claim 24, further comprising the steps of determining the existence of a media jam condition, and operating said drive train to separate said fuser roll and said backup roll.

26. The process of claim 23, further comprising the steps of determining the existence of a media jam condition, and operating said drive train to separate said fuser roll and said backup roll.

27. The process of claim 23, further comprising the step of providing data to the controller relative to desired print glossiness.

* * * * *